US006186123B1

(12) United States Patent
Maier et al.

(10) Patent No.: US 6,186,123 B1
(45) Date of Patent: Feb. 13, 2001

(54) FUEL INJECTION VALUE

(75) Inventors: Martin Maier, Möglingen; Christian Preussner, Markgröningen, both of (DE)

(73) Assignee: Robert Bosch GmbH, Stuttgart (DE)

( * ) Notice: Under 35 U.S.C. 154(b), the term of this patent shall be extended for 0 days.

(21) Appl. No.: 09/403,822

(22) PCT Filed: Jan. 29, 1999

(86) PCT No.: PCT/DE99/00237

§ 371 Date: Oct. 26, 1999

§ 102(e) Date: Oct. 26, 1999

(87) PCT Pub. No.: WO99/43950

PCT Pub. Date: Sep. 2, 1999

(30) Foreign Application Priority Data

Feb. 26, 1998 (DE) ..... 198 08 068

(51) Int. Cl.[7] ..... F02M 55/02
(52) U.S. Cl. ..... 123/470; 277/313
(58) Field of Search ..... 123/468, 469, 123/470, 509; 239/600; 277/313

(56) References Cited

U.S. PATENT DOCUMENTS

| | | | | |
|---|---|---|---|---|
| 3,038,456 | | 6/1962 | Dreisin . | |
| 3,244,377 | | 4/1966 | Roosa . | |
| 3,777,495 | * | 12/1973 | Kuze . | |
| 4,067,585 | * | 1/1978 | Rode | 123/470 |
| 4,528,959 | * | 7/1985 | Hauser, Jr. | 123/470 |
| 4,602,795 | * | 7/1986 | Lillibridge . | |
| 5,247,918 | | 9/1993 | Wakeman . | |

FOREIGN PATENT DOCUMENTS

| | | |
|---|---|---|
| 30 00 061 | 7/1981 | (DE) . |
| 95 24576 | 9/1995 | (EP) . |
| 1 219 366 | 5/1960 | (FR) . |
| 759 524 | 10/1956 | (GB) . |
| 09 126089 | 5/1997 | (JP) . |

* cited by examiner

*Primary Examiner*—Thomas N. Moulis
(74) *Attorney, Agent, or Firm*—Kenyon & Kenyon

(57) ABSTRACT

A fuel injection valve having a nozzle body can be inserted into a receiving bore of a cylinder head of an internal combustion engine for direct injection of fuel into the combustion chamber of the internal combustion engine. A metal ring arranged on the nozzle body is deformed when heated, producing a radial pressure of the fuel injection valve in the receiving bore only when heated after the fuel injection valve has been inserted into the receiving bore.

9 Claims, 2 Drawing Sheets

FUEL INJECTION VALUE

FIELD OF THE INVENTION

The present invention releates to a fuel injection valve having a nozzle body that can be inserted into a receiving bore of a cylinder head of an internal combustion engine for direct injection of fuel into the combustion chamber of the internal combustion engine.

BACKGROUND INFORMATION

Such fuel injection valves are described in German Patent No. 30 00 061 and British Patent No. 759 524. German Patent No. 30 00 061 describes the use of a heat shield sleeve on the nozzle body of the fuel injection valve. A flange of the heat shield sleeve is inserted into an inside groove in the fuel injection valve and sealed by a sealing ring with respect to the receiving bore of the cylinder head. On the spray side, the heat shield sleeve has a ring-shaped collar that is bent inward, with an elastic heat shield ring supported on the collar. The heat shield ring is arranged between the spray end of the nozzle body of the fuel injection valve and the ring-shaped collar of the heat shield sleeve that is bent inward.

With the fuel injection nozzle described in British Patent No. 759 524, a flexible heat shield element inserted between an end face of the nozzle body and a collar of a clamping nut is designed as a disk-shaped heat shield ring made of a thermal insulation material. To protect the inside of the heat shield ring, which is not covered by the collar or the nozzle body, from attack by combustion gases, the inside is bordered by a U-shaped ring of thin sheet metal.

A disadvantage of these conventional fuel injection valves is that the thermal coupling between the nozzle body and the cylinder head is not entirely satisfactory because the radial pressure is limited due to the maximum allowed assembly forces. Therefore, there is the risk of overheating the nozzle body and coking during operation of the internal combustion engine.

SUMMARY OF THE INVENTION

The fuel injection valve according to the present invention claim has the advantage that a good thermal connection of the fuel injection valve to the cylinder head is possible together with easy assembly of the fuel injection valve at the same time. The fuel injection valve can be inserted easily into the receiving bore due to the metal ring, which is arranged on the nozzle body and becomes deformed when heated, producing radial pressure of the fuel injection valve in the receiving bore only when heated after the fuel injection valve has been inserted into the receiving bore of the cylinder head. The metal ring nevertheless guarantees adequate radial pressure between the inserted fuel injection valve and the cylinder head, so that good thermal coupling is guaranteed. The metal ring deforms only when it reaches the required temperature during operation of the internal combustion engine.

The outside diameter of the metal ring before heating is advantageously smaller than the diameter of the receiving bore. This measure permits easy assembly of the fuel injection valve in the receiving bore. The metal ring is typically placed on and/or attached to the nozzle body before the fuel injection valve is inserted into the receiving bore. Room temperature usually prevails here. During operation of the internal combustion engine, the fuel injection valve reaches temperatures of up to approx. 200° C. However, coking may occur at this temperature. Due to the deformation of the metal ring when heating the fuel injection valve after startup of the internal combustion engine, the metal ring becomes deformed, producing a radial pressure of the fuel injection valve in the receiving bore so there is a good thermal connection to the cylinder head. This dissipates heat from the fuel injection valve over the cylinder head, so that the operating temperature of the fuel injection valve can be lowered to less than 150° C., thus preventing coking.

In an advantageous embodiment of the present invention, the metal ring is arranged in a groove of the nozzle body. This in particular guarantees even easier insertion of the fuel injection valve into the receiving bore and a secure axial mounting of the metal ring on the fuel injection valve.

In another advantageous embodiment of the present invention, the metal ring is attached by a fastening means to an outside wall of the nozzle body. For example, the fastening means may be formed by a weld, a clamp, rivets, screws, etc.

In one embodiment, the metal ring is preferably made of a bimetal. For example, the material of the metal ring here is steel on its inside facing the nozzle body and aluminum on its outside facing away from the nozzle body.

In an alternative embodiment, the metal ring is made of a memory metal. In this case, the metal ring has a diameter smaller than the diameter of the receiving bore of the fuel injection valve at room temperature, while it has a correspondingly larger diameter in the operating temperature range of the fuel injection valve, thus guaranteeing the required radial pressure.

In another alternative embodiment, the metal ring is made of a metal having a thermal expansion coefficient different from the thermal expansion coefficient of the nozzle body. The metal ring expands when heated to the operating temperature, but if it is arranged in the groove in the nozzle body, it can yield only in the radial direction toward the receiving bore, thus creating the radial pressure. The same thing is true for the case when the metal ring is attached to the nozzle body at or near its outside edges, because the intermediate area of the metal ring between the fastenings can yield only in the radial direction toward the receiving bore when heated to the operating temperature.

In all embodiments, the metal ring may be coated at least partially with a soft metal to permit a better adaptation to the fuel injection valve and the receiving bore of the cylinder head.

DETAILED DESCRIPTION

Figure 1:
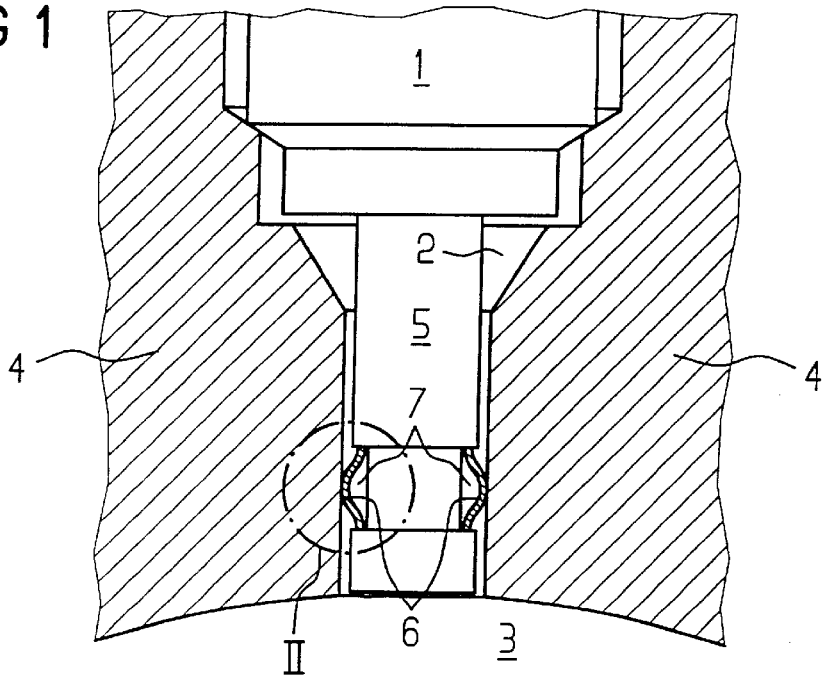
FIG. 1 shows a partially cutaway schematic diagram of a fuel injection valve according to the present invention inserted into a receiving bore of a cylinder head.

FIG. 1 shows a sectional view of a fuel injection valve 1 arranged in a receiving bore 2 of a cylinder head 4, shown partially cut away. Receiving bore 2 of cylinder head 4 is designed as a stepped bore, extending to a combustion chamber 3 of an internal combustion engine symmetrically with its longitudinal axis. Fuel injection valve 1 is inserted into this receiving bore 2 and injects fuel directly into combustion chamber 3 of the internal combustion engine. The fuel goes into combustion chamber 3 through the end of fuel injection valve 1 which faces combustion chamber 3.

The part of fuel injection valve 1 facing combustion chamber 3 is formed by a nozzle body 5. A metal ring 6 is arranged in a peripheral groove 7 of nozzle body 5, guaranteeing a thermal connection of fuel injection valve 1 to cylinder head 4 during operation of the internal combustion engine. In the example shown in FIG. 1, groove 7 with metal ring 6 is arranged near the spray end of nozzle body 5. This arrangement ensures that the heat which goes from combustion chamber 3 to the spray end of fuel injection valve 1 during operation of the internal combustion engine will be removed efficiently from fuel injection valve 1 to cylinder head 4.

In the view shown in FIG. 1, fuel injection valve 1 and thus also metal ring 6 are at operating temperature. Metal ring 6 is deformed so that fuel injection valve 1 is pressed radially in receiving bore 2. Since the metal ring has a smaller diameter m before heating and/or before reaching the operating temperature than after heating (diameter M), fuel injection valve 1 can be inserted easily into receiving bore 2. Through appropriate selection of materials and the shape of metal ring 6, a sufficient radial pressure is achieved after heating, so that a good heat transfer between fuel injection valve 1 and cylinder head 4 is guaranteed. The fit of metal ring 6 to receiving bore 2 of cylinder head 4 in the operating condition corresponds to a transition fit.

Figure 2:
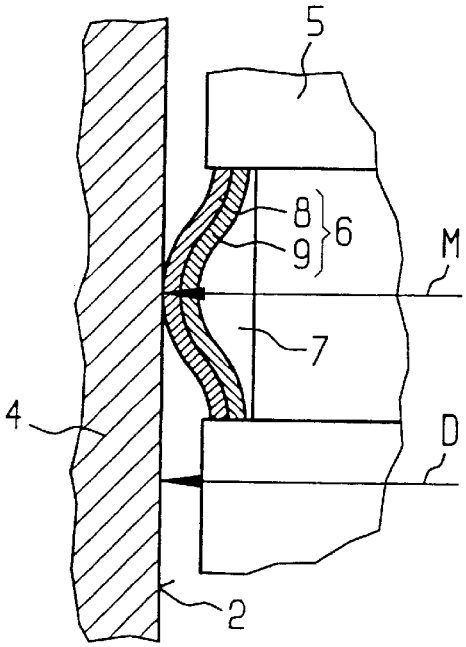
FIG. 2 shows an enlarged diagram of detail II shown in FIG. 1, where the metal ring is made of bimetal, and the fuel injection valve is at operating temperature.

FIG. 2 shows detail II from FIG. 1 for a first embodiment of metal ring 6, which is a bimetal ring here. Inner part 9 of metal ring 6 facing fuel injection valve 1 is made of steel, for example, and outer part 8 of metal ring 6 is made of aluminum, for example. FIG. 2 shows the operating state where the internal combustion engine is in operation, and fuel injection valve 1 and thus also metal ring 6 are heated accordingly. Metal ring 6 is deformed in this state so that it has an area with a largest outside diameter M, as shown in FIG. 2. This largest outside diameter M would be larger than diameter D of receiving bore 2 of fuel injection valve 1 if fuel injection valve 1 were not inserted into receiving bore 2, so that when inserted, a correspondingly large radial pressure of the fuel injection valve in receiving bore 2 is guaranteed.

Figure 3:
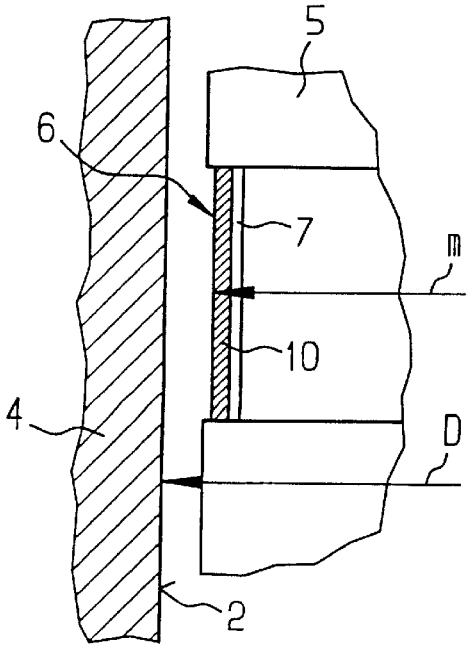
FIG. 3 shows an enlarged diagram of detail II shown in FIG. 1, where the metal ring is made of memory metal, and the fuel injection valve is at room temperature.

FIG. 3 shows detail II from FIG. 1 for a second embodiment of metal ring 6. In the second embodiment, metal ring 6 is made of a metal 10 with shape recall or metal ring 6 is made of a memory metal which assumes the same shape again whenever heated to a certain temperature range. FIG. 3 shows the state of metal ring 6 before reaching the operating temperature, i.e., at room temperature. In this state, largest diameter m of metal ring 6 is smaller than diameter D of the receiving bore, so that fuel injection valve 1 can be inserted easily into receiving bore 2. In the example shown here, diameter m at room temperature is smaller than the outside diameter of nozzle body 5 outside of groove 7, but it could also be somewhat larger as long as it is smaller than diameter D of receiving bore 2.

Figure 4:
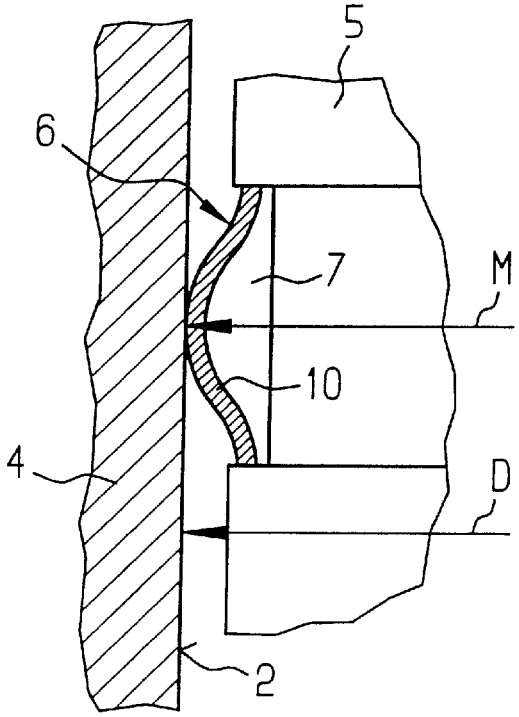
FIG. 4 shows an enlarged diagram of detail II shown in FIG. 1 where the metal ring is made of a memory metal, and the fuel injection valve is at operating temperature.

On reaching the operating temperature, metal ring 6 made of a memory metal 10 becomes deformed in such a way that the area with the largest diameter has a diameter M which, when fuel injection valve 1 is not inserted, is larger than diameter D of receiving bore 2. This yields a sufficient radial pressure with cylinder head 4, as shown in FIG. 4, because metal ring 6 is in contact with the wall of receiving bore 2, thus guaranteeing a good heat transfer.

As an alternative to the memory metal, metal ring 6 may also be made of a metal with a thermal expansion coefficient different from the thermal expansion coefficient of nozzle body 5, e.g., greater than it. In this case, the metal ring is braced in groove 7 in a form-fitting manner, expanding on heating and thus producing a radial pressure in receiving bore 2 because it cannot yield in the longitudinal direction.

Metal ring 6 in the embodiments described here is ideally designed so that it has areas with a diameter smaller than the diameter of nozzle body 5 even in the heated or hot operating state, so that metal ring 6 is still held in groove 7. In addition, metal ring 6 of the first and second embodiments has a diameter m which is smaller than diameter D of receiving bore 2 when the metal ring is at room temperature or is cold, so that fuel injection valve 1 can be inserted easily into receiving bore 2.

Figure 5:
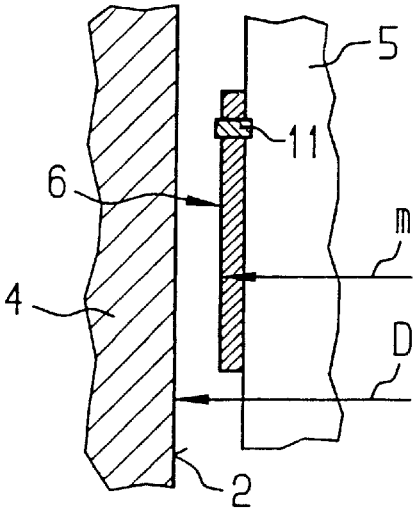
FIG. 5 shows a diagram corresponding to detail II shown in FIGS. 2–4, where the metal ring is attached to an outside wall of a nozzle body of the cylinder head by rivets and the fuel injection valve is at room temperature.
Figure 6:
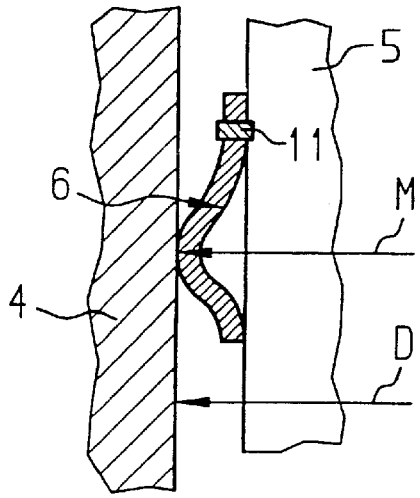
FIG. 6 shows a diagram corresponding to FIG. 5, where the fuel injection valve is at operating temperature.

FIGS. 5 and 6 show another embodiment of the present invention. FIGS. 5 and 6 show a detail of a fuel injection valve 1 which is inserted into a receiving bore 2 of a cylinder head 4 in accordance with the fuel injection valve shown in FIG. 1. The detail shown in FIGS. 5 and 6 corresponds to detail 2 from FIG. 1, but in this case nozzle body 5 does not have a groove 7 for holding metal ring 6. Metal ring 6 in the present embodiment is attached to an outside wall of nozzle body 5 by a fastening means in the form of rivets 11. Near its upper edge, metal ring 6 is fixedly connected to nozzle body 5, as shown in FIGS. 5 and 6. FIG. 5 illustrates the case where the fuel injection valve is at room temperature. In this state, metal ring 6 has a diameter m smaller than diameter D of receiving bore 2, so that fuel injection valve 1 can be inserted without difficulty into receiving bore 2. When the fuel injection valve and thus metal ring 6 are heated to the operating temperature, metal ring 6 becomes deformed as shown in FIG. 6, in the same way as explained with reference to FIGS. 2 and 4, producing a radial pressure with cylinder head 4. It should be pointed out that the case illustrated in FIGS. 5 and 6, where metal ring 6 is connected to nozzle body 5 only near one edge, requires metal ring 6 to be made of a bimetal or a memory metal. Only in these two cases can metal ring 6 become deformed on heating to operating temperature in such a way that the required radial pressure with cylinder head 4 is achieved. For the case when metal ring 6 is made of a metal having a thermal expansion coefficient different from the thermal expansion coefficient of nozzle body 5, metal ring 6 must be fixedly connected to the outside wall of nozzle body 5 near its two edge areas. The thermal expansion coefficient of metal ring 6 is advantageously greater than that of nozzle body 5. When heated to the operating temperature, the middle area of metal ring 6 becomes deformed in the radial direction toward receiving bore 2, thus producing a radial pressure.

Both embodiments of metal ring 6 can be coated with a soft metal to permit a better adaptation to groove 7 of nozzle body 5 and receiving bore 2 of cylinder head 4.

What is claimed is:

1. A fuel injection valve for a direct injection of a fuel into a combustion chamber of an internal combustion engine, comprising:

a nozzle body for inserting into a receiving bore of a cylinder head of the internal combustion engine; and a metal ring situated on the nozzle body, the metal ring deforming when heated, producing a radial pressure in the receiving bore only when heated after the nozzle body has been inserted into the receiving bore.

2. The fuel injection valve according to claim 1, wherein the metal ring has an outside diameter, before the metal ring is heated the outside diameter being smaller than a diameter of the receiving bore.

3. The fuel injection valve according to claim 1, wherein the nozzle body has a groove, the metal ring being situated in the groove.

4. The fuel injection valve according to claim 1, wherein the nozzle body has an outside wall, the metal ring being attached by a fastener to the outside wall.

5. The fuel injection valve according to claim 1, wherein the metal ring is made of a metal alloy.

6. The fuel injection valve according to claim 5, wherein the metal ring has an inside facing the nozzle body and an outside facing away from the nozzle body, the inside being made of steel, the outside being made of aluminum.

7. The fuel injection valve according to claim 1, wherein the metal ring is made of a memory metal.

8. The fuel injection valve according to claim 1, wherein the metal ring is made of a metal having a thermal expansion coefficient different from that of the nozzle body.

9. The fuel injection valve according to claim 1, wherein the metal ring is at least partially coated with a soft metal.

* * * * *